US006260792B1

(12) United States Patent
Zwirn et al.

(10) Patent No.: US 6,260,792 B1
(45) Date of Patent: Jul. 17, 2001

(54) TRACKING AND GUIDANCE SYSTEM WITH MODULATED MISSILE-MOUNTED LASER BEACON

(75) Inventors: Robert Zwirn; John W. Bozeman, both of Los Angeles, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 06/260,235

(22) Filed: May 4, 1981

(51) Int. Cl.[7] ..... F41G 7/20
(52) U.S. Cl. ..... 244/3.11
(58) Field of Search ..... 244/3.11, 3.12, 244/3.14, 3.16

(56) References Cited

U.S. PATENT DOCUMENTS

| | | | | |
|---|---|---|---|---|
| 2,930,894 | * | 3/1960 | Bozeman | 244/3.11 |
| 3,098,933 | * | 7/1963 | Barasch | 244/3.14 |
| 3,711,046 | * | 1/1973 | Barhydt et al. | 244/3.16 |
| 3,751,166 | * | 8/1973 | Starkey et al. | 244/3.16 |
| 3,761,180 | * | 9/1973 | Maxwell, Jr. et al. | 244/3.16 |
| 3,820,742 | * | 6/1974 | Watkins | 244/3.11 |
| 3,848,830 | * | 11/1974 | Born | 244/3.16 |
| 3,954,228 | * | 5/1976 | Davis, Jr. | 244/3.16 |
| 3,998,406 | * | 12/1976 | Smith et al. | 244/3.11 |
| 4,027,837 | * | 6/1977 | Miller, Jr. et al. | 244/3.11 |
| 4,047,117 | * | 9/1977 | Tuchyner et al. | 244/3.16 |
| 4,047,678 | * | 9/1977 | Miller, Jr. et al. | 244/3.16 |
| 4,162,052 | * | 7/1979 | Lamelot | 244/3.16 |
| 4,174,818 | * | 11/1979 | Glenn | 244/3.16 |
| 4,202,515 | * | 5/1980 | Maxwell, Jr. | 244/3.11 |

FOREIGN PATENT DOCUMENTS

| | | | |
|---|---|---|---|
| 1348940 | * | 3/1974 | (GB) . |
| 1455119 | * | 11/1976 | (GB) . |
| 1467552 | * | 3/1977 | (GB) . |
| 2017393 | * | 10/1979 | (GB) . |
| 1587698 | * | 4/1981 | (GB) . |
| 1596543 | * | 8/1981 | (GB) . |

* cited by examiner

*Primary Examiner*—Charles T. Jordan
(74) *Attorney, Agent, or Firm*—Colin M. Raufer; Glenn H. Lenzen, Jr.

(57) ABSTRACT

An improved tracking and guidance system is provided for line-of sight commanded missiles. The system includes a missile mounted laser beacon which is modulated at a predetermined frequency. An infrared sensor mounted on a tracking unit receives the incoming optical energy and provides a corresponding electrical output. The output signals are filtered to eliminate clutter and those signals outside the range of frequencies within which the laser is modulated. The filtered signals are then peak detected to determine missile azimuth and elevation within a predetermined window. Azimuth and elevation error detector circuits compare the missile azimuth and elevation to predetermined signals to generate error signals. The error signals are utilized by the missile guidance system to provide updated guidance commands.

3 Claims, 1 Drawing Sheet

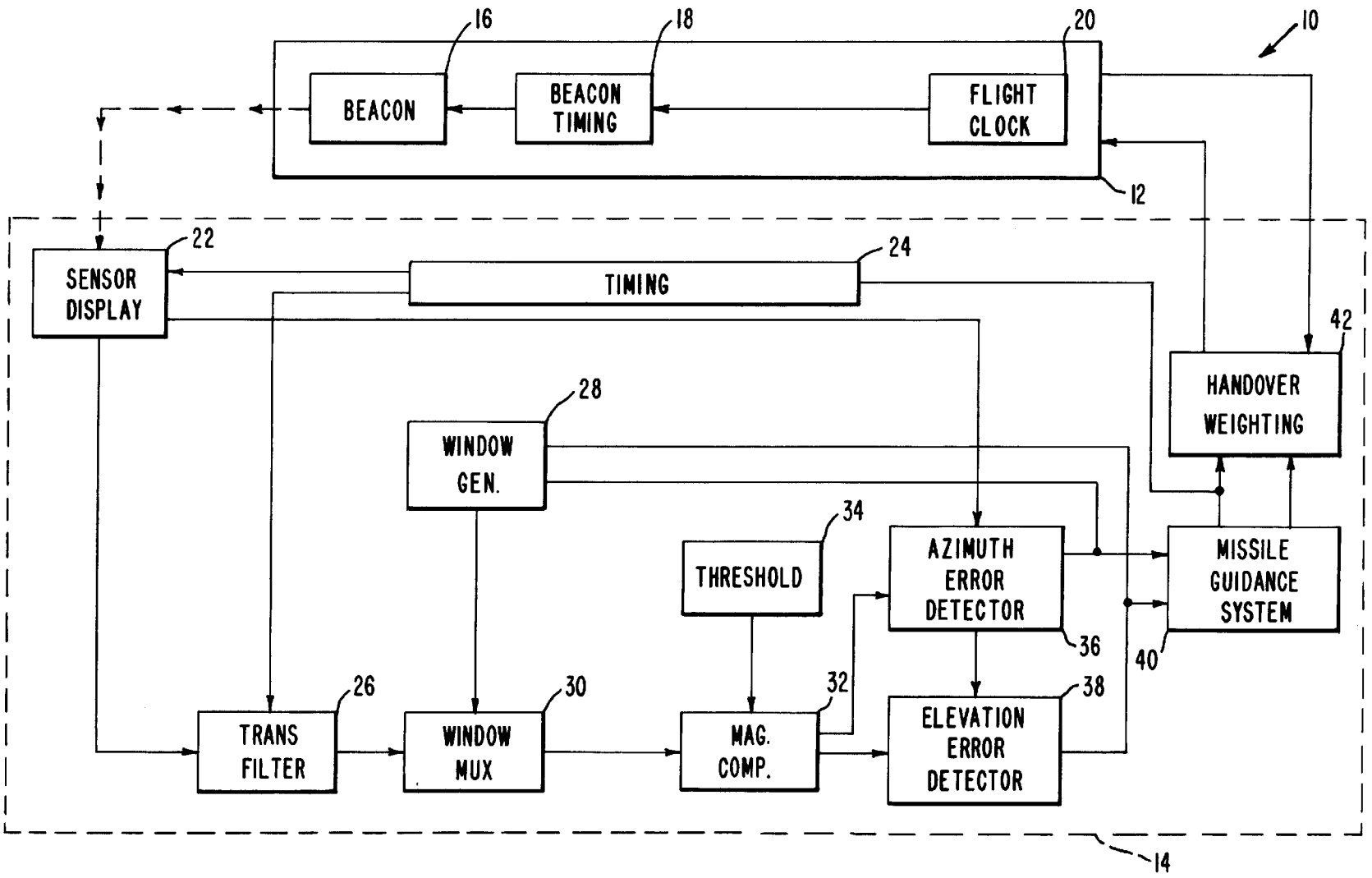
10
12
14
16
18
20
22
24
26
28
30
32
34
36
38
40
42
FLIGHT CLOCK
BEACON TIMING
BEACON
TIMING
SENSOR DISPLAY
HANDOVER WEIGHTING
MISSILE GUIDANCE SYSTEM
AZIMUTH ERROR DETECTOR
ELEVATION ERROR DETECTOR
THRESHOLD
MAG. COMP.
WINDOW GEN.
WINDOW MUX
TRANS FILTER

TRACKING AND GUIDANCE SYSTEM WITH MODULATED MISSILE-MOUNTED LASER BEACON

BACKGROUND OF THE INVENTION

1. Field of the Invention

This invention relates to missile guidance systems. More specifically, this invention relates to improvements in the tracking and guidance of line-of-sight commanded missiles.

While the present invention is described herein with reference to particular embodiments and applications, it is to be understood that the invention is not limited thereto. Modifications may be made within the teachings of this invention without departing from the true spirit and scope thereof.

2. Description of the Prior Art

A typical line-of-sight guided missile system includes a launcher and a guided missile. The launcher typically includes a gunner's optical sight and an electronic guidance computer which automatically sends steering commands to the missile in flight. After launch, a beacon in the tail of the missile is activated and subsequently detected by a sensor on the launcher. The sensor is boresighted with the gunner's telescope and allows the operator to track the missile along its flight path. The sensor and associated processing circuit measures the angle between the missile and the gunner's line-of-sight. These displacements are transformed by computer into guidance commands which are sent to the missile over the command link. The gunner need only keep the cross-hairs of the sight on the target during missile flight.

This system is effective under conditions in which the target is visible to the gunner. Its operability is limited as to targets which are obscured by darkness, smoke, haze or conditions of poor atmospheric visibility. When the system is augmented by forward-looking infrared (FLIR) sensor and display, the operator has the capability of seeing many targets which would be otherwise obscured.

The following patents are illustrative of the prior art systems described above:

| Pat. No. | Patentee | Issue Date |
|---|---|---|
| 3,711,046 | Barhydt et al | January 16, 1973 |
| 3,761,180 | Maxwell, Jr. et al | September 25, 1973 |
| 3,820,742 | Watkins | June 28, 1974 |
| 3,998,406 | Smith et al | December 21, 1976 |
| 4,027,837 | Miller, Jr. et al | June 7, 1977 |
| 4,047,678 | Miller, Jr. et al | September 13, 1977 |

These systems typically utilize a source of infrared radiation (i.e., xenon flare or gallium arsenide diode) as a beacon mounted on the aft end of the missile. Some of these references provide for modulation of the beacon. A beacon signature which is modulated can be extracted from clutter at longer ranges than the same unmodulated beacon. If the beacon is a laser, the range performance of the system is further enhanced. As compared to conventional sources of infrared radiation, laser beacons have greater smoke, haze, fog and darkness penetration capability. In addition, a laser beacon can be electrically modulated at a very high frequency to provide enhanced counter measure resistance. Prior art systems often require a mechanical modulation mechanism. Such systems may be so heavy as to impair the performance of the missile by decreasing its range and/or responsiveness.

SUMMARY OF THE INVENTION

The present invention provides means for improving the performance of line-of-sight commanded missile guidance and tracking systems. The invention contemplates the use of a laser as the missile beacon which is electrically modulated at a very high frequency. A remote tracking unit is provided for sensing the electromagnetic energy transmitted by the laser beacon and providing corresponding electrical signals. Electronic circuitry is provided within the tracker for filtering the received video data so that only those signals corresponding to the modulated beacon are allowed to be processed by the error detection circuitry. The error detection circuitry analyzes the filtered signals to provide an output indicative of the position of the missile relative to the gunner's cross-hairs.

BRIEF DESCRIPTION OF THE DRAWINGS

The FIGURE is a schematic diagram of a preferred embodiment of the present invention.

DETAILED DESCRIPTION OF THE INVENTION

The remote tracking and guidance system of the present invention is shown at 10 in FIG. 1. The system 10 includes a missile 12 and a tracking unit 14. The missile 12 is equipped with a laser beacon 16 which is mounted so that as the missile is in flight, the laser beacon is pointed in the direction of the tracking unit 14. Beacon timing circuitry 18 is provided which utilizes a flight clock 20 to modulate the laser beacon 16 at a frequency much higher than that of any other infrared source that may be expected in the vicinity of the missile as viewed from the tracker. In the preferred embodiment, the flight clock is synchronized with the tracking unit so that it drives the laser beacon at a rate in the neighborhood of 3 cycles per pixel.

The energy radiated from the laser beacon 16 is detected by an infrared sensor 22. The scan of the sensor 22 is controlled by timing circuit 24 to insure synchronization with the flight clock 20. The sensor 22 provides electrical signals representative of the scene in the tracker field of view. These electrical signals are filtered by transversal filters 26 to produce a matched filter output. The output for a signal produced by the high frequency modulation of the laser beacon 16 is distinctive. Clutter components from the scene or decoy beacons which are at the wrong frequency are rejected. In the preferred embodiment, the transversal filters 26 serve as match filters and are implemented as change coupled devices (CCD's). Nonetheless, it is contemplated that any match filter may be utilized to perform the function of filtering video data to extract the signal modulated at a predetermined frequency.

Window generator 28 cooperates with the multiplexer 30 to provide a video gate to insure that only video signals in the vicinity of the previous missile location are processed. This aids in the avoidance of ambiguity from other infrared sources. A magnitude comparator 32 examines the output of the window multiplexer 30 and compares it to a predetermined threshold stored in register 34. The azimuth and elevation error detectors receive signals from the sensor 22 which represent the center of the gunner's field of view. These signals are used as reference signals by which the output of the magnitude comparator is analyzed. When the multiplexer output exceeds the threshold, the magnitude comparator 32 inputs to the azimuth and elevation error detectors 36 and 38 which produce outputs proportional to the deviation of the missile 12 from the center of the gunner's optical sight. The missile guidance system 40 conditions the signals from the azimuth error detector 36 and elevation error detector 38 to derive signals which steer the missile to the center of the field of view. These signals are transmitted to the missile 12 via hand over weighting circuit 42. This circuit functions to enable control of the missile unit by the FLIR tracker 22 when the operator is utilizing the system in the FLIR mode.

While the present invention has been described herein with reference to a particular embodiment, it is to be understood that the invention is not limited thereto. Those having ordinary skill in art will recognize that the present invention may be modified to secure the advantages thereof without departing from the true spirit and scope of the present invention. It is contemplated by the appended claims to cover any and all such modifications.

What is claimed is:

1. A system for remote tracking and guidance of a missile comprising:

a laser beacon mounted on said missile for transmitting infrared energy;

first circuit means mounted on said missile for electrically modulating the output of said laser at a predetermined frequency;

an infrared sensor and display mounted on a tracking unit remote from said missile for receiving the infrared energy transmitted by said laser and radiated by objects within the vicinity thereof and providing electrical signals corresponding thereto;

second circuit means electrically connected to said infrared sensor for filtering said electrical signals to extract signals corresponding to the infrared energy transmitted by said laser; and third circuit means for analyzing the signals corresponding to the infrared energy transmitted by said laser to provide second electrical signals indicative of the position of said missile.

2. The system of claim 1 including means for displaying infrared energy received by said infrared sensor.

3. A system for remote tracking and guidance of a missile comprising:

a laser beacon mounted on said missile for transmitting infrared energy;

first circuit means mounted on said missile for electrically modulating the output of said laser at a predetermined frequency;

an infrared sensor and display mounted on a tracking unit remote from said missile for receiving the infrared energy transmitted by said laser and radiated by objects within the vicinity thereof and providing electrical signals corresponding thereto;

second circuit means electrically connected to said infrared sensor for filtering said electrical signals to extract signals corresponding to the infrared energy transmitted by said laser; and third circuit means for analyzing the signals corresponding to the infrared energy transmitted by said laser to provide second electrical signals indicative of the position of said missile and for displaying said received infrared energy.

* * * * *